United States Patent [19]

Meyer et al.

[11] Patent Number: 4,907,615

[45] Date of Patent: Mar. 13, 1990

[54] HIGH FREQUENCY RESPONSE SERVOVALVE WITH ELECTRICAL POSITION FEEDBACK ELEMENT STRUCTURE AND METHOD

[75] Inventors: Endre A. Mayer, Birmingham; Robert D. Kachman, Troy, both of Mich.

[73] Assignee: Schenck Pegasus Corporation, Troy, Mich.

[21] Appl. No.: 116,912

[22] Filed: Nov. 5, 1987

[51] Int. Cl.[4] ..... F15B 13/43

[52] U.S. Cl. ..... 137/1; 137/625.62; 137/625.63; 137/625.64

[58] Field of Search ..... 137/625.62, 625.63, 137/625.64, 1

[56] References Cited

U.S. PATENT DOCUMENTS

| | | | |
|---|---|---|---|
| 2,953,123 | 9/1960 | Reen et al. | 137/625.64 X |
| 4,266,572 | 5/1981 | Schuttenberg et al. | 137/625.64 X |
| 4,456,031 | 6/1984 | Taplin | 137/625.64 X |
| 4,623,003 | 11/1986 | Leonard | 137/625.64 |

FOREIGN PATENT DOCUMENTS

| | | | |
|---|---|---|---|
| 1082339 | 7/1980 | Canada | 137/625.64 |
| 124242 | 11/1984 | European Pat. Off. | 137/625.64 |

*Primary Examiner*—Gerald A. Michalsky

*Attorney, Agent, or Firm*—Reising, Ethington, Barnard, Perry & Milton

[57] ABSTRACT

Electrohydraulic servovalve structure and method. The servovalve structure has minimum oil passage length and oil volume and a high response force motor with a light weight armature and a stiff flexible tube and includes a second stage pilot valve having an axially movable metering spool therein and a non contacting, electromagnetic, proximity type sensor positioned adjacent one end of the spool for converting axial spool position to an electrical signal. In modifications, a quartz or ceramic window is placed between the one end of the spool and sensor and electronics are placed on the servovalve adjacent the sensor for providing a low impedance spool position output signal from the servovalve. In accordance with the method of the invention, the axial position of the spool is sensed by the eddy current sensor and an electrical signal is provided representative of the position of the spool for use in controlling the electrohydraulic servovalve. In a modification, the position representative signal is converted to a low impedance signal at the servovalve.

26 Claims, 1 Drawing Sheet

HIGH FREQUENCY RESPONSE SERVOVALVE WITH ELECTRICAL POSITION FEEDBACK ELEMENT STRUCTURE AND METHOD

BACKGROUND OF THE INVENTION

1. Field of the Invention

The invention relates to electrohydraulic servovalve structures and methods. More specifically the invention refers to a high frequency response, second stage or pilot valve with electrical position feedback for use in a three stage, electrohydraulic servovalve. The feedback is developed by a non contacting, electromagnetic, proximity type sensor in the second stage pilot valve having a spool member. The sensor which is separated from the spool by a window is operable to convert spool position into an electrical signal. Sensor electronics for converting a high impedance signal to a lower impedance signal are provided on the pilot valve adjacent the sensor to increase the distance the signal representative of spool position may be effectively transmitted.

2. Description of the Prior Art

In seismic exploration work, a very high frequency response, rugged, high flow, electrohydraulic servovalve is needed. Electrohydraulic servovalves for such work are often three stage valves including a first stage force motor, a second stage, pilot valve and a third stage, metering valve.

Prior electrohydraulic servovalves used in seismic exploration requiring feedback from the pilot valve to the force motor electrical input have been limited in the pilot valve in that, in the past, developing an electrical signal representative of the position of the valve member of the pilot valve has placed some physical restraint on the movement of the valve member. Thus, for example, linear voltage differential transformers require a physical connection to the valve member whereby friction is created on side loading the linear voltage differential transformer.

Also the mass of the core of the linear voltage differential transformer attached to the valve member in the prior pilot valve structures increases the inertia of the valve members, thereby reducing the frequency response of the valve.

Further, the larger the volume of oil required to operate the pilot valve of such electrohydraulic servovalves, the lower the frequency response of the valve. With prior electrohydraulic servovalves, the pilot stage has had a greater than necessary oil volume therein as for example in pilot valves wherein linear voltage differential transformers are utilized to provide an electrical feed back signal.

In addition prior electrohydraulic servovalves have not had as high a frequency response as desired due to the frequency response of the force motor utilized in the first stage thereof. Thus, with force motors of the past, the armatures have not been as light as possible, the flexure tubes utilized therein have not been as stiff as desired, the inductance of the force motors has been higher than desired and dynamic balance of the armature with the drive arm has not normally been accomplished.

The above noted deficiencies in the prior art have resulted in three stage electrohydraulic servovalves which do not have as high a frequency response as desired for many applications, and in particular seismic exploration work.

SUMMARY OF THE INVENTION

In accordance with the present invention, a new servovalve structure and method is provided which is particularly suited for seismic exploration work. The servovalve of the invention is a very high frequency response, high flow, rugged valve.

In particular, the servovalve structure of the invention includes a pilot stage with a spool valve, oil metering member and a non contacting, electromagnetic proximity type sensor which may be separated from the spool by a window. The structure of the invention also includes electronics for converting a high impedance signal to a low impedance signal immediately adjacent the sensor for converting spool position to a low impedance electrical signal representative of the spool position. Further, in accordance with the structure of the improved electrohydraulic servovalve of the invention, the pilot stage of the valve is constructed and arranged to minimize oil flow passage lengths and oil volumes whereby the frequency response of the electrohydraulic servovalve is improved by increasing the value of the resonant frequency of the pilot stage. Also, the first stage of the improved electrohydraulic servovalve in accordance with the invention is a high response force motor including a light weight armature, a stiff flexure tube, a low inductance coil and a stiff drive arm.

The method of the invention includes the step of sensing the axial position of a metering spool with a non contacting, electromagnetic, proximity type sensor to provide a low impedance electrical signal representative of the axial position of the spool in the pilot valve, second stage of an electrohydraulic servovalve and constructing the pilot stage with a minimum oil volume. The method of the invention also includes the provision of a high response force motor as a first stage for the electrohydraulic servovalve.

DESCRIPTION OF THE PREFERRED EMBODIMENT

Figure 1:
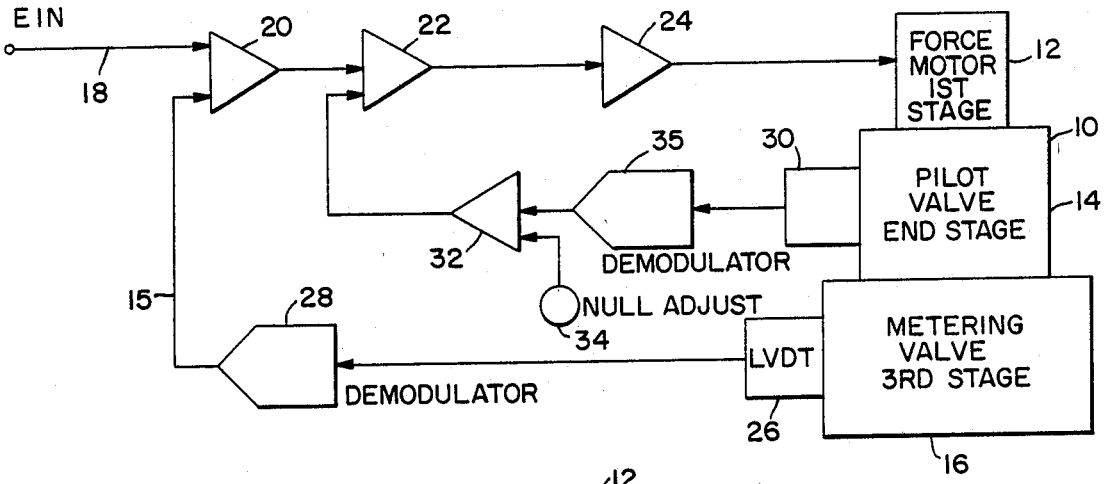
FIG. 1 is a block diagram of an electrohydraulic servovalve constructed in accordance with the invention for effecting the method of the invention in a control circuit for the electrohydraulic servovalve.

The electrohydraulic servovalve 10 of the invention includes a first stage force motor 12, second stage pilot valve 14, and a third stage metering valve 16. In particular, the force motor, first stage 12 and the second stage, pilot valve 14 are constructed in accordance with the invention and operate in accordance with the method of the invention.

As shown best in FIG. 1, the three stage electrohydraulic servovalve 10 is connected in a control circuit 15 providing feedback from the pilot stage 14 and from the metering stage 16 to vary an input demand signal in accordance with the position of the valve members of the second and third stage 14 and 16 of the electrohydraulic servovalve 10.

Briefly, the control circuit 15 includes an input conductor 18 for receiving a first electrical signal from an external source, requesting for example a predetermined flow in gallons per minute through the third stage 16 of the electrohydraulic servovalve 10. The first or demand signal over the conductor 18 is passed through differential amplifiers 20 and 22 and through amplifier 24 to actuate the force motor 12.

The demand signal passing through the differential amplifier 20 is varied in accordance with the position of a metering valve in the third stage 16 of the electrohydraulic servovalve 10 as sensed by a linear voltage differential transformer 26 which is physically connected to the metering valve. The signal from the linear voltage differential transformer 26 is passed through a demodulator 28 and the signal from the demodulator 28 is utilized to vary the input demand signal in accordance with the actual position of the metering valve of the third stage 16 of the electrohydraulic servovalve 10.

Thus, for example, if the position of the metering valve of the third stage 16 of the electrohydraulic servovalve 10 is such that five gallons per minute of fluid is metered through the metering valve, the signal from the demodulator will be the same as the demand signal on the input conductor 18 requesting five gallons per minute flow through the metering valve of the third stage 16. Accordingly, if the demand signal is equal to the actual volume of fluid metered through the third stage 16 of the electrohydraulic servovalve 10, no output signal will be present from the differential amplifier 20, thus requiring no movement of the valve member of the third stage 16 of the linear voltage differential transformer.

Similarly, in accordance with the control circuit 15 of FIG. 1 for the electrohydraulic servovalve 10, the position of a metering spool 68 in the second or pilot stage 14 of the electrohydraulic servovalve 10 is sensed by a sensor 30 which provides an electrical output signal representative of the axial position of the spool. After the signal representative of the position of the valve member of the second stage 14 is demodulated in demodulator 35 it is passed through a differential amplifier 32 to the differential amplifier 22 where it is used to again vary the input demand signal in accordance with the sensed position of the metering spool 68 of the second stage 14 of the electrohydraulic servovalve 10.

Again, the demand signal from the differential amplifier 20 represents a demand for a greater or lesser flow of fluid through the electrohydraulic servovalve 10 and the signal from the second stage 14 of the electrohydraulic servovalve 10 represents the flow through the second stage 14 of the servovalve 10 in accordance with the sensed position of the metering spool thereof.

Any differential signal coming out of the differential amplifier 22 also represents a desired change in the position of the metering spool of the second stage 14 of the electrohydraulic servovalve 10, which of course may be due to a desired change in the position of the third stage valve member as reflected by the actual position thereof and the original demand signal on the conductor 18.

The ultimate differential demand signal is then passed through the amplifier 24 to the force motor 12 and is reflected in the position of the metering spool in the second stage 14 of the electrohydraulic servovalve 10 and the fluid metered therethrough and in the ultimate position of the valve member of the third stage 16 of the electrohydraulic servovalve 10 and the fluid metered therethrough which should be in the exact amount demanded by the signal input on the conductor 18.

The differential amplifier 32 is utilized to provide a null adjustment for the second stage of the electrohydraulic servovalve 10. That is to say, the position of the valve spool in the second stage 14 of the electrohydraulic servovalve 10 for a particular demand signal into the differential amplifier 22 may be varied by adjusting the signal provided to the differential amplifier 32 through a zero adjust circuit 34. This adjustment provides an exact output from the second stage servovalve 14 in accordance with the demand signal out of the differential amplifier 22.

Figure 2:
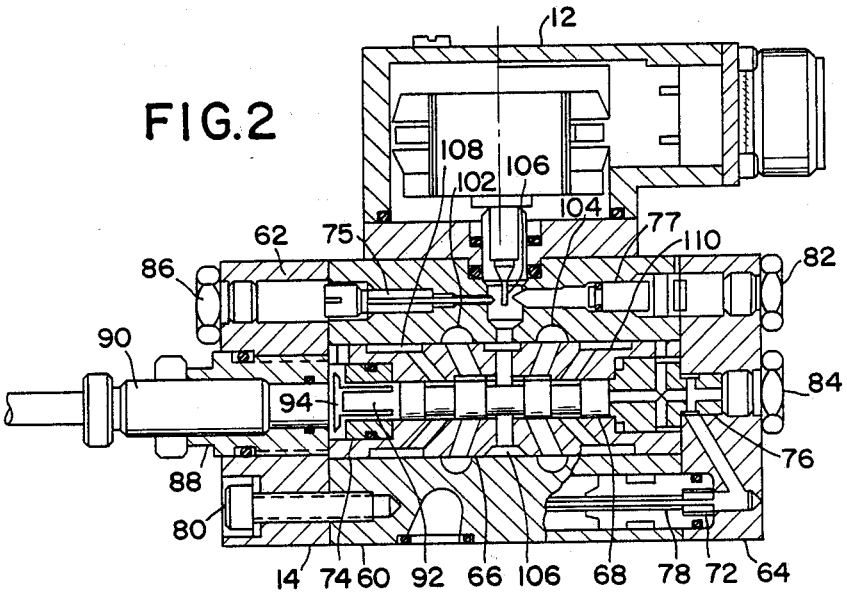
FIG. 2 is a partial longitudinal section view through the force motor, first stage and the pilot valve second stage of the electrohydraulic servovalve illustrated in FIG. 1.

The first stage of the electrohydraulic servovalve 10, as shown best in FIG. 2, is a high frequency force motor constructed in accordance with the disclosures of U.S. patent application Ser. No. 614,070 filed on May 25, 1984, now abandoned, the inventors of which are the same as the inventors in the present application.

The force motor 12, however, includes a light weight armature constructed of a magnetic material. Also, the flexure tube is relatively stiff, having a wall thickness of approximately 0.012 inches to produce a higher mechanical resonance. The force motor 12 has a low inductance coil, which generates approximately 0.02 henries at 400 hertz. A stiff drive arm is provided on the force motor 12 to provide dynamic balance of the armature. Since the force motor 12 is substantially completely disclosed in the above referenced patent application, it will not be considered in further detail herein.

The second or pilot stage 14 of the electrohydraulic servovalve 10, as shown best in FIG. 2, includes body member 60, left end cap 62, right end cap 64, sleeve 66, and metering spool 68. In the modification of the pilot stage 14 of the electrohydraulic servovalve 10 shown in FIG. 2, the metering orifices 70 (not shown) and 72 are provided in the body member 60 at the opposite ends of the filter means 78. Manifold members 74 and 76 are provided at the opposite ends of the metering spool between the metering spool and the end cap as shown. Nozzles 75 and 77 are also provided in body member 60 along with filter means 78 for filtering hydraulic actuating oil for the pilot valve 14.

The end caps 62 and 64 are secured to the body member 60 by convenient means, such as the bolts 80. Plugs such as plugs 82, 84 and 86 are utilized to close necessary construction openings in the end caps. The plugs may have expansion plugs to reduce fluid in the pilot valve 14 if desired.

In accordance with the invention, as shown in FIG. 2, a sensor adapter 88 is threaded into the end cap 62 and a non contacting, electromagnetic, proximity type sensor 90 is secured in the sensor adapter adjacent the end 92 of the spool 68. The sensor 90 may be an Electromike model 4947, and is commercially available. The sensor 90 operates in accordance with the principles of eddy currents generated by the sensor in conductive metal objects, that is, the spool of the servovalve. Suitable electronic circuits convert the eddy currents in the sensor to an output voltage which is essentially proportional to the distance between the spool and the sensor.

To enhance the development of eddy currents in the sensor, a metal target 94 is positioned on the end 92 of the spool 66. The target is made of steel to enchance the sensitivity of the sensor.

The operation of the pilot stage 14 of the electromagnetic servovalve 10 is to a point conventional. Thus, oil under pressure is passed through the filter means 78, the orifice 70 and 72 in the end caps 62 and 64, through the manifolds 74 and 76 and the passages provided thereby, through the sleeve 66 at the opposite ends thereof and through nozzles 75 and 77 toward the flapper valve 100 of the force motor 12.

In accordance with the position of the flapper 100 as regulated by the demand signal provided the force motor 12 the pressure at one end or the other of the metering spool 68 may be higher or lower than that at the other end creating a pressure differential that will move the metering spool axially.

Movement of the metering spool axially will cause actuating fluid such as hydraulic oil to move from one of the metering channels 102 and 104 toward the exhaust channel 106 and will cause movement of the hydraulic oil into the other metering channel from the associated hydraulic fluid supply channel 108 or 110. As shown in FIG. 2 the hydraulic fluid from the nozzles 75 and 77 also passes into the exhaust channel 106.

Such is the normal operation of electromagnetic servovalves.

However, in accordance with the invention as the spool 68 moves axially it encounters no resistance to its movement by the eddy current sensor 90 which does not contact the metering spool or the metal target 94 placed on the end 92 of the spool 68.

Further because of the construction and arrangement of the fluid passage in the pilot valve 14 of the electrohydraulic servovalve 10 as shown in FIG. 2 whereby fluid passage lengths are maintained at a minimum and because of the general construction of the pilot valve 14 of the electrohydraulic servovalve 10, the volume of oil within the pilot valve 14 is minimized. Thus the frequency of response of the pilot valve, second stage 14 of electrohydraulic servovalve 10 is improved by increasing the value of the resonant frequency of the pilot valve given by the formula $$\omega_H = \sqrt{\frac{2A^2}{VEM}}$$

Wherein:

$\omega_H$, is the hydraulic frequency of the pilot valve 14;

A, is the crosssectional area of the spool;

V, is the volume of the fluid in the pilot valve 14;

E, is the elastic modulus of the fluid in the pilot valve; and

M, is the mass of the spool.

Figure 3:
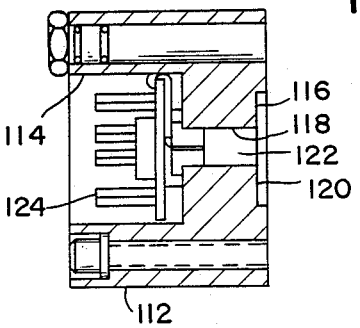
FIG. 3 is a section view of a modification of the sensor structure of the second stage of the electrohydraulic servovalve illustrated in FIG. 1.

Further, shown best in FIG. 3 the sensor adapter 88 and sensor 90 may be replaced by a modified end cap 112 which is a bit longer than end cap 62 and includes recesses 114 and 116 therein along with opening 118 passing between the recesses 114 and 116. A quartz or ceramic window 120 is secured in the recess 116. The eddy current sensor structure 122 is secured to the window 120 adjacent the end 94 of the spool valve 68. Electronics 124 associated with the eddy current sensor structure 112, are positioned in the recess 114.

The window 120 permits much higher oil pressure within the pilot valve 14 since the pressure is not limited by the strength of the eddy current sensor 122 as it is by the eddy current sensor 90 shown in FIG. 2 exposed directly to the oil in the pilot valve 14. Thus, with the pilot valve configuration illustrated in FIG. 2 oil pressure within the valve 14 is currently limited to approximately 300 lbs. per square inch while with a pilot valve having the construction of FIG. 3 including the quartz window, which is not subject to damage as readily as glass for example, but is still substantially transparent to electromagnetic forces, the pressure within the pilot valve 14 has been tested to as high as 5000 pounds per square inch.

The electronics 124 provided in the end cap 112 reduce the impedance of the circuit associated with the eddy current sensor 122 whereby the signal representative of the position of the spool valve 68 may be transmitted over a substantial distance. Transmittal of the feedback electric signal from sensors such as the sensor 90 shown in FIG. 2 wherein the output signal is a high impedance signal is substantially limited as compared to the ability to transmit the feedback signal from a pilot valve having sensor means 112 and electronic structure 124 in the end cap 112.

It will be understood by those in the art that the third stage 16 of the electrohydraulic servovalve 10 is conventional and may in fact be a Schenck Pegasus Model 1820, third stage, metering valve having a linear voltage differential transformer sensor 26 attached thereto. These valves are commercially available and will not therefore be considered in detail herein.

While one embodiment of the present invention and a modification thereof have been considered in detail, it will be understood that other embodiments and modifications are contemplated. It is the intention to include all embodiments and modifications of the invention as are defined by the appended claims with the scope of the invention.

We claim:

1. A high frequency response electrohydraulic servovalve including a first stage, high response force motor, a second stage, pilot valve, and a third stage, metering valve connected in series so that the force motor controls the pilot valve and the pilot valve controls the metering valve, means for providing a first electrical signal representing a demand flow through the third stage metering valve, a first differential amplifier, a second differential amplifier and a third amplifier in series between the means for providing the first electrical signal and the force motor for passing the first signal, modified in the differential amplifiers to the force motor, said second stage; pilot valve including a metering spool movable and unbiased axially to control fluid flow therethrough in accordance with the electrical signal passed to the force motor, a non contacting, electromagnetic, proximity type sensor positioned adjacent one end of the metering spool to sense eddy currents on axial movement of the spool and to convert them into a second electrical signal representative of the position of the spool in the pilot valve for providing a feedback signal to the second differential amplifier for altering the first electrical signal modified in the first differential amplifier in accordance with the position of the metering spool, a valve member in the third stage, metering valve, a linear voltage differential transformer positioned on the metering valve of the electrohydraulic servovalve for providing an electrical signal representative of the position of the valve member of the third stage of the electrohydraulic servovalve and means for passing the electrical signal representative of the position of the valve member of the third stage of the electrohydraulic servovalve to the first differential amplifier for modifying the first electrical signal as it is passed through the first differential amplifier in accordance with the position of the valve member of the third stage of the electrohydraulic servovalve.

2. Structure as set forth in claim 1 wherein the electrohydraulic servovalve includes an end cap adjacent the one end of the metering spool having an opening therethrough on the axis of the metering spool, and a window in the opening and wherein the sensor is on the other side of the window from the one end of the metering spool.

3. Structure as set forth in claim 2 wherein the window is constructed of one of quartz or a ceramic material.

4. Structure as set forth in claim 2 and further including electronic means immediately adjacent the sensor in the end cap and connected to the sensor for reducing the impedance of the electrical signal from the electrohydraulic servovalve.

5. Structure as set forth in claim 1 and further including electronic means immediately adjacent the sensor on the electrohydraulic servovalve and connected to the sensor for reducing the impedance of the electrical signal from the electrohydraulic servovalve.

6. A method of providing an electrical signal representative of the axial position of a pilot valve metering spool in an electrohydraulic servovalve including a force motor, a pilot valve and a metering valve, comprising converting the pilot valve metering spool position to an electrical signal with a non contacting, electromagnetic, proximity type sensor positioned adjacent one end of the pilot valve metering spool and converting the electrical signal to a low impedance electrical signal at the electrohydraulic servovalve.

7. The method as set forth in claim 6 wherein the non contacting, electromagnetic, proximity type sensor positioned adjacent the one end of the spool valve is an eddy current sensor and the sensor senses eddy currents produced as a result of the proximity of the one end of the spool to the sensor.

8. The method as set forth in claim 6 and further including providing a window between the one end of the metering spool and the sensor.

9. A high frequency response electrohydraulic servovalve comprising a force motor first stage, a pilot valve second stage and a metering valve third stage, an external electrical input signal for the force motor first stage, two differential amplifiers in series between the external electrical input signal and the force motor first stage of the electrohydraulic servovalve, said pilot valve stage including an unbiased metering spool with a longitudinal axis movable axially to meter fluid through the pilot valve stage to control the metering valve stage, a non contacting, electromagnetic, proximity type sensor positioned adjacent one end of the pilot valve stage metering spool for converting pilot valve metering spool axial position into a pilot valve electrical signal and means for feeding the pilot valve electrical signal to the second differential amplifier, said metering valve stage also including a metering spool with a longitudinal axis movable axially to meter fluid through the metering valve stage and a linear voltage differential transformer operably associated with the metering valve metering spool for providing a metering valve electrical signal and means for feeding the metering valve electrical signal to the first differential amplifier.

10. Structure as set forth in claim 9 and further including an end cap on the pilot valve second stage of the electrohydraulic servovalve adjacent one end of the pilot valve metering spool having an opening therethrough on the axis of the metering spool and a non conducting window in the opening, and wherein the sensor is on the other side of the window from the one end of the metering spool.

11. Structure as set forth in claim 10 wherein the means for feeding the pilot valve electrical signal from the pilot valve stage to the second differential amplifier includes a demodulator and a third differential amplifier in series between the sensor and the second differential amplifier, and further including a null adjust structure and means for feeding a null adjust signal from the null adjust structure to the third differential amplifier.

12. Structure as set forth in claim 9 and further including an end cap on the pilot valve and wherein the sensor is in the end cap and electronic means immediately adjacent the sensor in the end cap of the pilot valve second stage connected to the sensor for reducing impedance associated with the pilot valve electrical signal.

13. A high frequency response electrohydraulic servovalve including a pilot valve stage having a metering spool with a longitudinal axis movable axially to meter fluid through the servovalve and no biasing spring acting on the metering spool and a non contacting, electromagnetic, proximity type sensor positioned adjacent one end of the pilot valve stage metering spool for converting pilot valve metering spool axial position into an electrical signal wherein the electrohydraulic servovalve includes an end cap adjacent the one end of the metering spool having an opening therethrough on the axis of the metering spool and a window in the opening and wherein the sensor is on the other side of the window from the one end of the metering spool.

14. Structure as set forth in claim 13 wherein the proximity type sensor is an eddy current sensor.

15. Structure as set forth in claim 13 and further including a target member on one end of the spool for increasing the sensitivity of the sensor.

16. Structure as set forth in claim 13 wherein the electrohydraulic servovalve includes an end cap adjacent the one end of the metering spool and the sensor extends through the end cap on the axis of the spool.

17. Structure as set forth in claim 13 wherein the window is constructed of one of quartz or a ceramic material.

18. Structure as set forth in claim 13 and further including electronic means immediately adjacent the sensor in the end cap and connected to the sensor for reducing the impedance of the electrical signal from the electrohydraulic servovalve.

19. Structure as set forth in claim 13 wherein the pilot valve includes passages therein having hydraulic oil in them which passage lengths and the volume of which oil are minimized to improve frequency response of the electrohydraulic servovalve by increasing the value of the resonant frequency of the pilot valve.

20. Structure as set forth in claim 13 wherein the electrohydraulic servovalve further includes a high response force motor including at least one of, a light weight armature of magnetic material, a stiff flexure tube having a wall thickness of approximately 0.012 inches for producing high mechanical resonances, a low inductance coil of approximately 0.02 henry at approximately 400 hertz, and a stiff drive arm for providing dynamic balance of the armature.

21. A high frequency response electrohydraulic servovalve including a pilot valve stage having a metering spool with a longitudinal axis movable axially to meter fluid and no biasing spring acting on the metering spool, a non contacting, electromagnetic, proximity type sensor positioned adjacent one end of the pilot valve metering spool for converting pilot valve metering spool axial position into an electrical signal and electronic means immediately adjacent the sensor on the electrohydraulic servovalve and connected to the sensor for reducing the impedance of the electrical signals from the electrohydraulic servovalve.

22. Structure as set forth in claim 21 wherein the proximity type sensor is an eddy current sensor.

23. Structure as set forth in claim 21 and further including a target member on one end of the spool for increasing the sensitivity of the sensor.

24. Structure as set forth in claim 21 wherein the electrohydraulic servovalve includes an end cap adjacent the one end of the metering spool and the sensor extends through the end cap on the axis of the spool.

25. Structure as set forth in claim 21 wherein the pilot valve includes passages therein having hydraulic oil in them, which passage lengths and the volume of which oil are minimized to improve frequency response of the electrohydraulic servovalve by increasing the value of the resonant frequency of the pilot valve.

26. Structure as set forth in claim 21 wherein the electrohydraulic servovalve further includes a high response force motor including at least one of, a light weight armature of magnetic material, a stiff flexure tube having a wall thickness of approximately 0.012 inches for producing high mechanical resonances, a low inductance coil of approximately 0.02 henry at approximately 400 Hertz, and a stiff drive arm for providing dynamic balance of the armature.

* * * * *